US005135781A

United States Patent [19]

Schluckebier et al.

[11] Patent Number: 5,135,781

[45] Date of Patent: Aug. 4, 1992

[54] PROCEDURE FOR OPERATING A HOT METALLIZING FURNACE

[75] Inventors: Dieter Schluckebier, Simmerath; Peter Knupfer, Aachen, both of Fed. Rep. of Germany

[73] Assignee: Otto Junker GmbH, Fed. Rep. of Germany

[21] Appl. No.: 397,433

[22] PCT Filed: Jan. 26, 1988

[86] PCT No.: PCT/DE88/00036

§ 371 Date: Jul. 31, 1989

§ 102(e) Date: Jul. 31, 1989

[87] PCT Pub. No.: WO88/05831

PCT Pub. Date: Aug. 11, 1988

[30] Foreign Application Priority Data

Feb. 3, 1987 [DE] Fed. Rep. of Germany ..... 3703108

[51] Int. Cl.[5] ..... B05D 1/18

[52] U.S. Cl. ..... 427/431; 118/419; 219/421; 219/422; 266/120; 373/144; 427/433; 427/434.2

[58] Field of Search ..... 118/419; 427/431, 433, 427/434.2, 434.3, 436; 373/144, 152, 160, 161; 266/120; 219/10.71, 421, 422

[56] References Cited

U.S. PATENT DOCUMENTS

| | | | |
|---|---|---|---|
| 1,523,647 | 1/1925 | Imhoff | 219/424 |
| 2,669,647 | 2/1954 | Segsworth | 219/10.71 |
| 3,478,156 | 11/1969 | Segsworth | 373/146 |

FOREIGN PATENT DOCUMENTS

| | | | |
|---|---|---|---|
| 1583445 | 9/1971 | Fed. Rep. of Germany | 373/144 |
| 60-52567 | 3/1985 | Japan | 427/433 |
| 565105 | 10/1944 | United Kingdom . | |
| 2162863 | 2/1986 | United Kingdom . | |

*Primary Examiner*—Michael Lusignan
*Assistant Examiner*—Terry J. Owens
*Attorney, Agent, or Firm*—Mason, Fenwick & Lawrence

[57] ABSTRACT

In the operation of a hot metallizing furnace for lengths of metal, in particular metal strip, in which the length of metal to be coated is passed from above through the upper zone of a smelt of a coating material located in a smelt container, the smelt container can be heated by means of an induction coil made up of partial coils arranged axially on top of one another. During hot metallizing the upper partial coil(s) is/are connected to a medium frequency source of electricity in a single-phase manner. For the removal of the deposits which accumulate in the lower area of the smelt vessel, the lower partial coil(s) is/are connected to a three-phase current mains frequency source of electricity. The agitated deposits are then removed from the smelt using a collecting vessel.

2 Claims, 1 Drawing Sheet

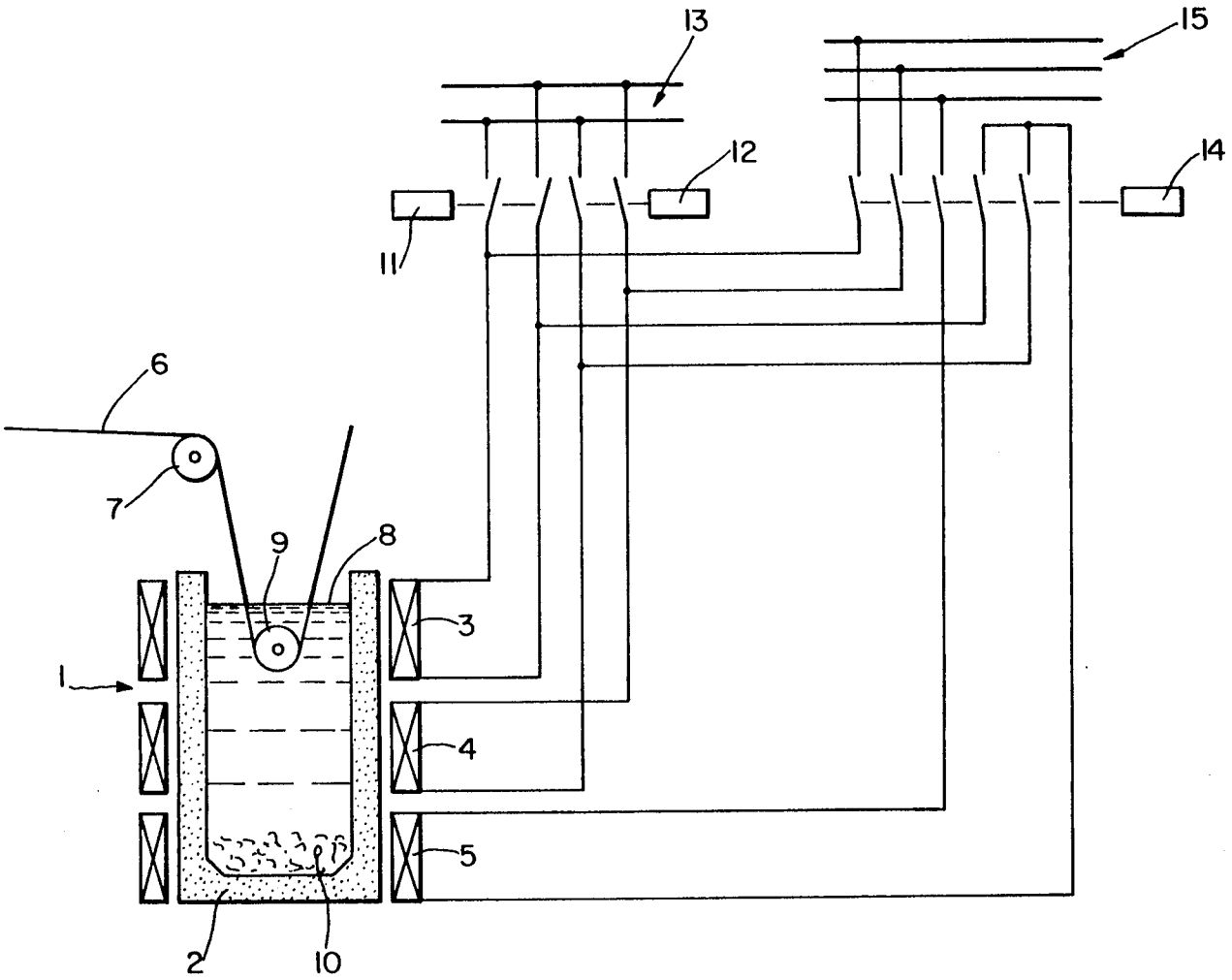
15
14
13
12
11
3
4
5
8
9
10
6
7
2
1

PROCEDURE FOR OPERATING A HOT METALLIZING FURNACE

The invention relates to a procedure for operating a hot metallizing furnace for lengths of metal, in particular metal strip, in which the length of metal to be coated is fed from above through the upper area of a smelt of coating material located in a smelt container, and whereby the smelt container is heatable by an induction coil made up of partial coils arranged axially above one another, and in which during hot metallization a bath movement is produced only in the upper area of the smelt by means of switching on the upper partial coil(s) only, while in order to remove deposits, in particular hard zinc deposits, from the smelt container, a bath movement is generated in the lower part of the smelt by switching on the lower partial coil(s).

A hot immersion metallizing furnace is known from DE PS 34 28 999 with a crucible which is surrounded externally by a cylindrical induction coil consisting of several partial coils arranged on top of one another. Here, the depth of the crucible should be equal to or greater than its diameter. During hot metallizing with this known furnace, only the upper partial coils should be switched on. In this way the metal smelt can be heated inductively to a sufficient degree and a stirring effect in the smelt can take place in the upper zone of the container. The movement in the smelt should become progressively weaker towards the bottom of the container, so that deposits of hard zinc or the like settle and remain in the lower part of the crucible and are not entrained up to the top during the metallization process, which would have negative effects on the quality of the strip surface.

The deposits in the lower area of the crucible, which increase in the course of service life, must be removed periodically. For this purpose it is proposed in accordance with DE-PS 34 28 999 to activate the lower partial coil also. As a result of this, the hard zinc or similar deposits are swirled up to the top.

The task of the present invention consists in further improving the operational mode of a hot metallizing furnace with inductive heating, whereby in the upper part of the smelt during the hot metallization procedure only a small stirring effect is produced with a high concentration of power, but for the purpose of removing hard zinc and similar deposits a particularly intensive agitation of the smelt is achieved.

This task is solved in accordance with the invention by a procedure of the kind described at the beginning in that during hot metallizing the upper partial coil(s) is/are connected to a medium frequency source of electricity in a single-phase manner; in that for the removal of the deposits which have collected in the lower area of the smelting vessel, the lower partial coil(s) is/are connected to a mains frequency source of electricity with a three-phase current; and in that the deposits thus agitated are removed from the smelt by means of a collecting tank.

The procedure in accordance with the invention on the one hand ensures that the stirring effect during the heating phase of metallization is relatively small and only present in the upper part of the molten coating metal, so that a distinct separation is achieved between an upper agitated area and a non-agitated lower area of the molten metal.

On the other hand, a particularly intensive stirring effect is produced for the removal of the hard zinc and similar deposits from the bottom area of the smelting vessel. In this way the deposits in the bottom area of the smelting vessel are swirled upwards and distributed roughly evenly throughout the whole depth of the melting bath. When the collecting tank is immersed in the molten metal, the agitated particles can settle in this collecting tank.

The procedure in accordance with the invention can be further developed in an advantageous manner in that for the removal of the deposits, lower and upper partial coils are connected with a mains frequency source of electricity with a three-phase current. In this way the agitation of the deposits is rendered more rapid and more intensive.

In the following the invention is described in more detail with the aid of a practical embodiment:

The FIGURE illustrates a hot metallizing furnace and partial coils according to this embodiment.

A hot immersion metallizing furnace 1 is proposed which has a beaten crucible 2 and partial coils 3, 4 and 5 surrounding this. A metal strip 6 which is to be coated is fed via a guide roller 7 into a smelt 8 of a coating material, out of which it is then fed upwards over a guide roller 9 and passed on for further treatment. Prior to its immersion in the smelt 8, the metal strip 6 is subjected to a cleaning and heating process.

The deposits which accumulate over a longish period of service of the furnace in the lower area of the crucible 2 are numbered 10.

During the metallizing phase the partial coils 3 and 4 are connected to a medium frequency alternating current circuit 13 via relay switches 11 and 12. As a result, the smelt 8 is intensively heated with a moderate bath movement. Depending on the energy requirement of the smelt it may only be necessary to switch on one of the two partial coils 3 and 4.

If the deposits 10 on the floor of the crucible have accumulated in the course of the hot metallizing process to such an extent that there is a danger of them swirling upwards under the influence of the electric field of partial coil 4, then generally only the partial coil 3 is supplied with current.

In the practical embodiment shown in the drawing, for the removal of the deposits 10 from the bottom of the crucible all the partial coils 3, 4 and 5 are connected via switching contacts of a contractor 14 to a mains frequency three-phase current supply 15 in such a way that a connecting terminal connects each partial coil 3, 4 and 5 with one phase of the mains frequency three-phase current supply 15 and the other connecting terminals of the partial coils are brought together at a common star point. The contactors 11 and 12 have here interrupted the energy supply from the medium frequency alternating current supply 13 to the partial coils 3 and 4.

By connecting all partial coils 3, 4 and 5 to the mains frequency three-phase current supply 15 in the manner described above, an intensive agitation of the smelt 8 and thus also of the deposits 10 at the bottom of the crucible is achieved. After an agitation phase of approx. 10 to 15 minutes, all three partial coils 3, 4 and 5 are switched off via the contractor 14.

Subsequently, a trough-shaped collecting vessel not illustrated in the drawing is immersed into the smelt 8, which collects at least the greater part of the particles, e.g. hard zinc particles, in the smelt which are already sinking back down to the bottom. Then the collecting vessel is lifted back out of the crucible 2 together with the deposits. The production process of the furnace installation can then be resumed without any significant delay.

We claim:

1. In a method for the operation of a hot metallizing furnace for lengths of metal, including the steps of:

(1) passing the lengths of metal to be coated from above through the upper region of a coating material located in a smelt container, the smelt container being heated by means of an induction coil made up of partial coils arranged axially on top of one another, and (2) during hot metallizing, producing a bath movement only in the upper area of the smelt by switching on the upper partial coil, while during agitation of deposits which have accumulated in the lower area of the smelt container producing a bath movement in the lower area of the smelt by switching on the lower partial coil, the improvement comprising:

(a) connecting the upper partial coil to receive electricity from a medium frequency source of electricity in a single-phase manner during hot metallizing, (b) connecting the lower partial coil to receive electricity from a three-phase current mains frequency source of electricity during agitation of deposits which have accumulated in the lower area of the smelt container, and (c) then removing from the smelt by use of a collecting vessel the accumulated deposits agitated in step (b).

2. The method of claim 1, wherein said connecting in step (b) comprises:

connecting the lower and upper partial coils to receive electricity from a three-phase current mains frequency source of electricity.

* * * * *